United States Patent [19]

Miyamoto

[11] Patent Number: 4,590,451

[45] Date of Patent: May 20, 1986

[54] INTERLOCKING CONTACTOR ASSEMBLY

[75] Inventor: Motomu Miyamoto, Tokyo, Japan

[73] Assignee: SUN-S Company Ltd., Kanagawa, Japan

[21] Appl. No.: 711,725

[22] Filed: Mar. 14, 1985

Related U.S. Application Data

[63] Continuation-in-part of Ser. No. 500,148, Jun. 1, 1983, Pat. No. 4,513,269.

[30] Foreign Application Priority Data

Mar. 29, 1984 [JP] Japan ..... 59-61557

[51] Int. Cl.[4] ..... H01H 9/20

[52] U.S. Cl. ..... 335/161; 335/160; 335/159; 335/136; 335/137; 200/50 R

[58] Field of Search ..... 335/160, 161, 159, 136, 335/137; 200/50 C

[56] References Cited

U.S. PATENT DOCUMENTS

| | | | |
|---|---|---|---|
| 2,446,299 | 2/1944 | Nelson | 335/160 |
| 2,606,260 | 8/1952 | Frese | 335/160 |
| 3,936,782 | 2/1976 | Moakler et al. | 335/161 |
| 4,513,269 | 4/1985 | Miyamoto | 335/132 |

*Primary Examiner*—E. A. Goldberg
*Assistant Examiner*—Lincoln Donovan
*Attorney, Agent, or Firm*—Fred Philpitt

[57] ABSTRACT

A star-delta contactor in which a traveling contact is provided with a pair of contact bases which are formed as a slide metal. The contact bases perform a seesaw movement in a direction where their mutual end portions are engaged and are bent at the connection portion in a direction where their mutual end portions are separated, and each of traveling iron cores of two electromagnets m1, m2 has an operation frame for respectively operating a pair of the traveling contact bases, and a spring is provided for respectively separating the traveling iron core when the electromagnet is deenergized.

7 Claims, 14 Drawing Figures

INTERLOCKING CONTACTOR ASSEMBLY

RELATED APPLICATION

This application is a continuation-in-part application of our copending application, Ser. No. 500,148 on June 1, 1983 now U.S. Pat. No. 4,513,269.

BACKGROUND OF THE INVENTION

This invention relates to a contactor and said contactor constituting a star-delta main circuit similar to a conventional three contactor system of wiring a combination of a plurality of contactors is provided as a structural member and an electromagnet is maintained in a deenergized condition at operation of the delta wiring. The contactor is composed of a case member, two electromagnets disposed at right and left on the lower surface of the case member, a traveling contact of slide metal system capable of bending in middle in each pole chamber, a stationary contact, two electromagnets disposed at right and left on the lower surface of the case, a pair of operation frames for rotary bending operation of the traveling contact, a metal cam for connection of the lower ends of the operation frames with each traveling iron core of the two electromagnets, drive springs disposed on the traveling iron cores of the two electromagnets and consisting of a plate spring for returning the traveling iron core from the stationary iron core when the electromagnet is deenergized, and a contact mechanism for causing the mechanical delta connection by the deenergization of the other electromagnet and holding the electromagnet in the delta wiring operation in the deenergized condition.

Heretofore, star-delta startings of a two-contactor system and a three-contactor system were generally employed as the starting system of motor, but the electromagnetic contactors available in market were of a one dimensional contact mechanism and were required of employing a circuit construction using a plurality of electromagnetic contactors star connection starting of star-delta, delta connection and contact for operation and for construction of main circuit. Particularly, the three-contactor system had a complete circuit construction and was capable of cutting a power source of the motor at operation stop, but an extra MMC electromagnetic contactor was required, and a considerable time and labor were required for wiring operation and mounting of equipment. Including a mounting area for equipment and wiring space, an accommodating area became far bigger, and sizes of cabinets or mounting boards tended to become big, resulting numerous drawbacks.

Moreover, during the operation of motor, the electromagnets are required to keep the energized condition, and long hours of sustaining such energization causes various troubles of adverse influences over adjacent equipment due to temperature rise or roaring, resulting in numerous drawbacks.

SUMMARY OF THE INVENTION

An object of this invention is to provide a contactor in which a conventional star-delta main circuit of a three-contactor system, a combination of a plurality of contactors, is formed as one structural member.

Another object of this invention is to provide a novel contactor in which a contact mechanism of mechanical function by spring force at deenergization time of electromagnet is provided which replaces changeover from a star-connection to a delta-connection, and during delta wiring operation, the electromagnet is deenergized after the delta connection and the various difficulties encountered during motor operation by long hours of sustaining energization of electromagnets can be eliminated and the saving on electric power is materialized.

A still another object of this invention is to provide a contactor in which one structural member is provided with only 18 contacts against a requirement of 36 contacts in a conventional three-contactor system star-delta main circuit, and yet, a main circuit same with said star-delta main circuit can be provided.

DETAILED DESCRIPTION OF THE INVENTION

Figure 1:
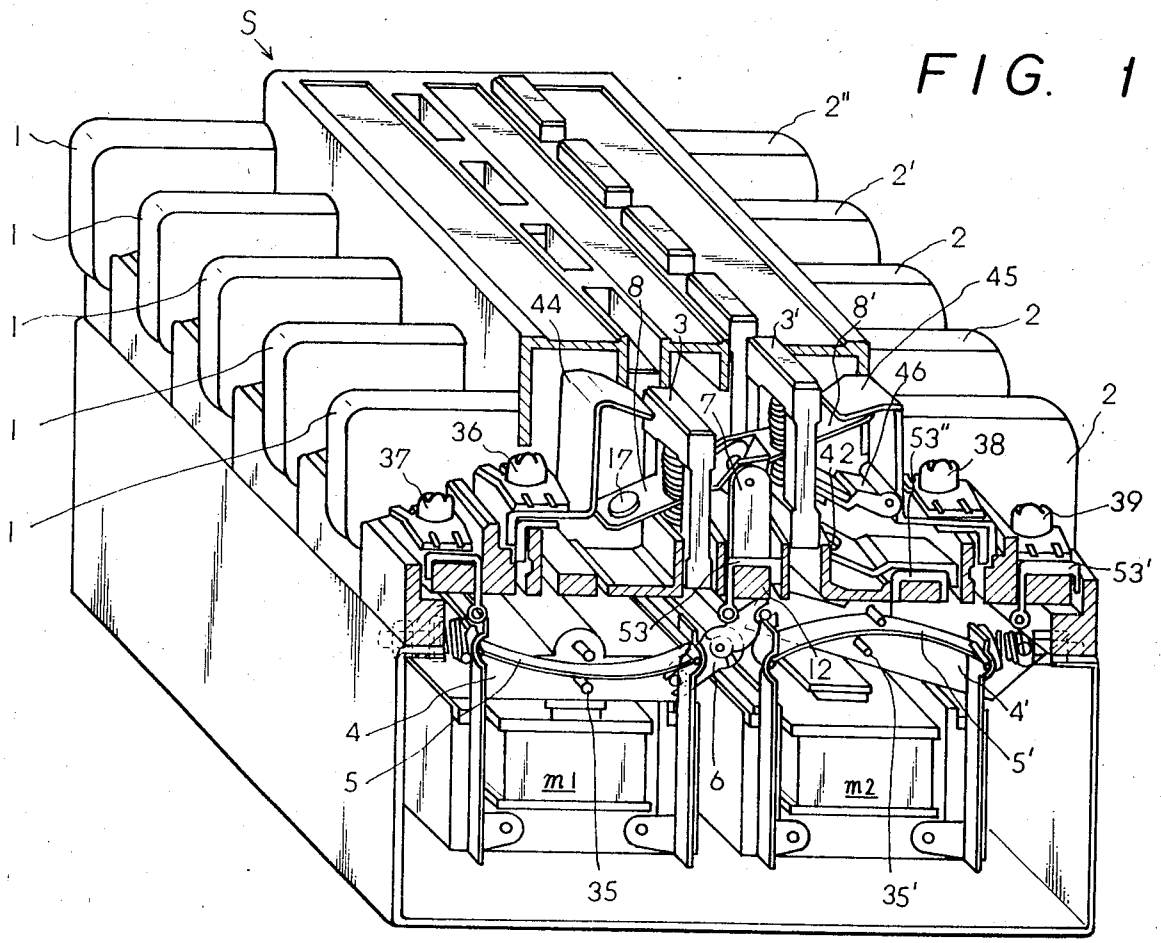
FIG. 1 is a perspective view of the contactor in which the contact mechanism is illustrated in partial section.
Figure 2:
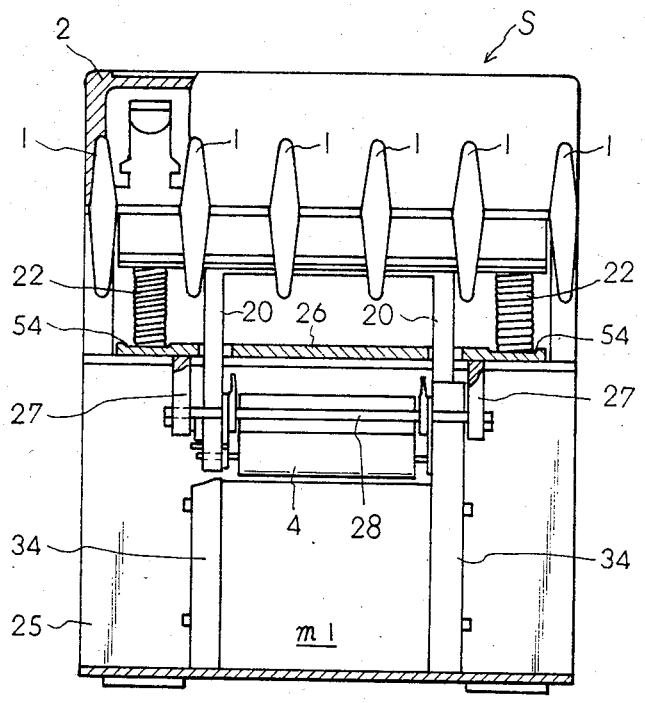
FIG. 2 is a side view showing the contactor in partial cross section.
Figure 3:
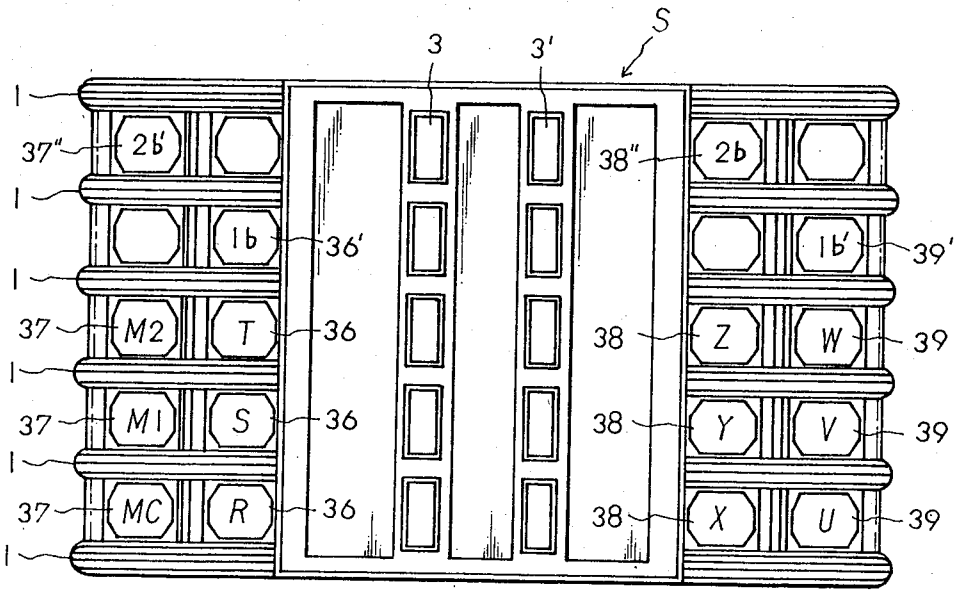
FIG. 3 is a top view of the contactor.

This invention relates to a contactor in which a star-delta main circuit construction of three-contactor system is provided in which a case member S consists of pole chambers 2, 2, 2 for main contact vertically partitioned by a plurality of diaphragms 1, and pole chambers 2', 2'' for auxiliary contacts which are provided serially. On the lower surface of the case S, two electromagnets m1 and m2 are provided, and each pole chamber 2, 2, 2 and 2', 2'' for main contacts and auxiliary contacts are provided by assembling a traveling contact mechanism consisting of a slide metal capable of bending in middle, a stationary contact mechanism, a pair of operation frames 3, 3' for switching operation of the traveling contact mechanism, drive springs 5, 5' consisting of plate springs provided on each traveling iron core 4, 4' of the electromagnets m1, m2, and a metal cam 6 for connection of the pair of operation frames 3, 3' and the electromagnets m1, m2 coaxially. A contact mechanism is provided in which the one electromagnet m1 is energized for turning the power source OFF, and the other electromagnet m2 is energized for making and star connection starting, and the delta connection in the traveling contact and the stationary contact for main contact is mechanically connected by the spring force of the drive spring 5' when the electromagnet m2 is deenergized by a timer or time up of a set time of a delay relay, and one structural member constitutes a star-delta main circuit corresponding to the conventional three-contactor system star-delta main circuit construction, and at the same time, after the delta connection, namely, during the delta-connection operation, the electromagnets m1 and m2 are retained in the deenergized condition.

Figure 4:
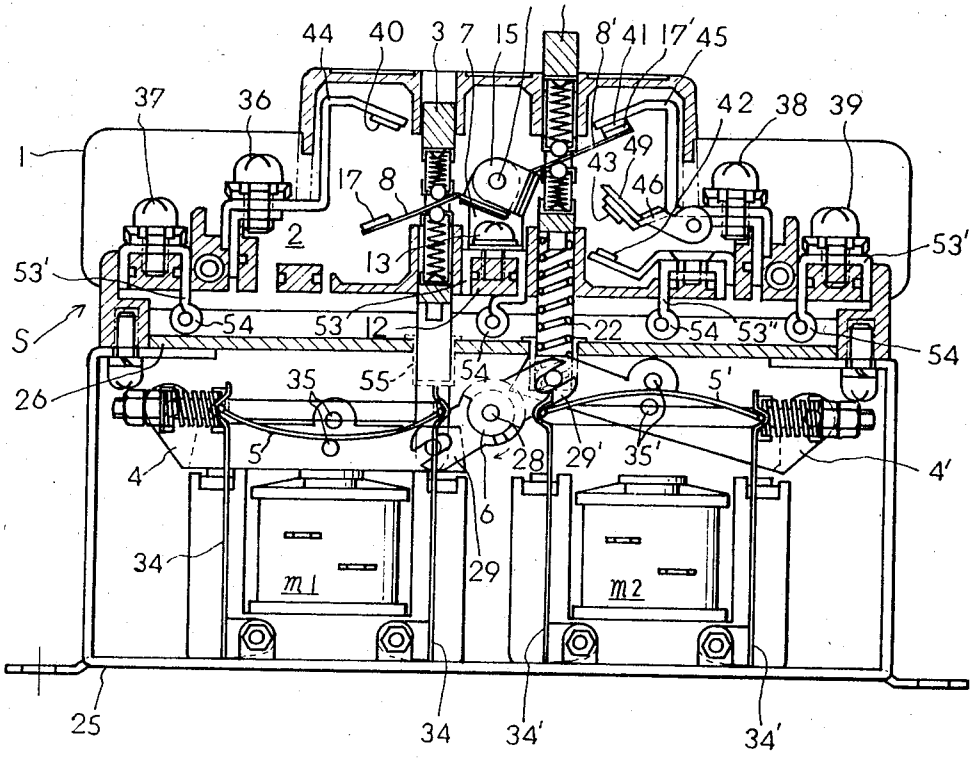
FIG. 4 is a vertical cross section showing the main contact in OFF condition.
Figure 5:
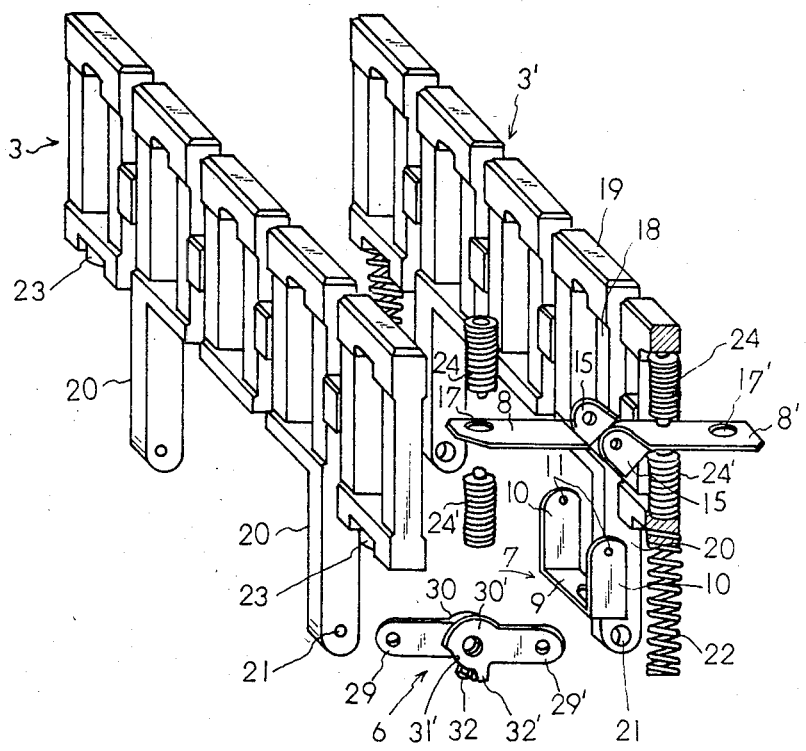
FIG. 5 is a perspective view of disassembled traveling contact.

The traveling contact mechanism provided in the pole chambers 2, 2, 2 for the main contact is formed of the support frame 7 made of electroconductive material and a pair of traveling contact bases 8, 8 as shown in FIGS. 4, 5, 7, 9 and 10, and the support frame 7 of U-shape is provided with a bottom portion 9 and two sheets of vertical frame portions 10, and a bearing portion 11 is formed on an upper end of the vertical frame portion 10, and this support frame 7 is fixed to a base portion provided on a bottom portion of a center of the case S by the bottom portion 9 by means of a screw 13. Said pair of traveling contact bases 8, 8' are formed with bearing portions 15, 15' at both side portions of the bent portions 14, 14' which are formed by bending base ends thereof in a predetermined angle as shown in FIG. 5, and said pair of traveling contact bases 8, 8' are pivotally fixed at the bearing portions 15, 15' and said pair of traveling contact bases 8, 8' are engaged freely at the end portions 14*a*, 14*a*' of the mutual bent portions 14, 14', and in case either the traveling contact base 8 or 8' is applied with pressure to rotate in a direction where the end portions 14*a*, 14*a*' of the mutual bent portions 14, 14' are engaged, said pair of traveling contact bases 8, 8' are interlockingly rotated to make a seesaw movement, and in case either of said traveling contact base 8 or 8' is rotated in a direction where the end portions 14*a*, 14*a*' of the mutual end portions 14, 14' are separated, said pair of the traveling contact bases 8, 8' are independently rotated to form a slide metal structure which bends in middle at the connecting portion. The mutual end portions 14*a*, 14*a*' are engaged freely at positions where said pair of traveling contact bases 8, 8' become a straight line by the bearing portions 15, 15', and the bent portions 14, 14' are set to be downward to be pivotally fixed to the bearing portion 11 of the support frame 7 by a pivotal shaft 16, and traveling contacts 17, 17' of main contact are provided on the upper surface of tips of said traveling contact bases 8, 8'.

A pair of the operation frames 3, 3' are formed in such a way as shown in FIG. 5 that a leg portion is integrally suspended and projected from one side portion on the lower surface of a frame portion 19 having a rectangular window 18, and an axial hole 21 extending therethrough is formed at a lower end of the leg portion 20, and a projecting member 23 is provided for installing a return spring 22 on the lower surface of the frame portion 19. A pair of the operation frames 3, 3' are disposed liftably at positions on both sides of the support frame 7, and said pair of traveling contact bases 8, 8' extend through the respective windows 18 of the right and left operation frames 3, 3' to be located at positions where the traveling contacts 17, 17' of main contact extend through the window 18. Each window 18 of each operation frames 3, 3' at right and left is fixed with a pair of vertical contact springs 24, 24' at an upper end and lower end on the window 18, and a pair of traveling contact bases 8, 8' are resiliently sandwiched between mutual free ends of contact springs 24, 24' of upper and lower portions.

Figure 8:
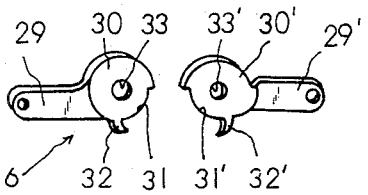
FIG. 8 is a perspective view of a disassembled metal cam.

A flat plate 26 is installed to cover an upper surface of a mount 25 for incorporating said two electromagnets m1 and m2, and a bearing portion 27 is provided on the reverse side of the flat plate 26, and a metal cam 6 is pivotally fixed to the bearing portion 27 at its center portion by means of a pivotal shaft 28, and the lower ends of the leg portions 20 of the right and left operation frames 3, 3' and the traveling iron cores 4, 4' of the electromagnets m1, m2 respectively are coaxially pivotally fixed at each right and left by means of the metal cam 6. The metal cam 6, as shown FIG. 8, is formed in such a way that disc portions 30, 30' provided on base end sides of a pair of arm portions 29, 29' are formed with notches 31, 31' at predetermined portions of obliquely lower portion of its outer circumference, and pawl members 32, 32' formed in projection mode at end portions on lower side of the notches 31, 31'. The pivotal shaft 28 is inserted into the center holes 33, 33' of the disc portions 30, 30' to be rotatably connected to engage the mutual pawl members 32, 32'. While the pawl members 32, 32' are positioned in a range of the notches 31, 31', a pair of the arm portions 29, 29' are independently rotatable, and when the pawl members 32, 32' are mutually engaged, said pair of arm portions 29, 29' are interlockingly rotated. The axial hole 21 of the lower end of the leg portion 20 of the operation frame 3 and the tip of the traveling iron core 4 of the electromagnet m1 are coaxially and pivotally fixed to the arm portion 29 of the metal cam 6, and the axial hole 21 of the lower end of the leg portion 20 of the other operation frame 3' and the tip of the traveling iron core 4' of the electromagnet m2 are coaxially pivotally fixed to the other arm portion 29'.

Drive springs 5, 5' made of plate springs are provided on each traveling iron core 4, 4' of the electromagnets m1 and m2, and these drive springs 5, 5' are installed in the curved condition between upper ends of a pair of holding frames 34, 34' suspending at a predetermined interval for each of said electromagnets m1, m2, and each traveling iron core 4, 4', a pair of projecting members 35, 35' are projected in its almost center portion vertically at a predetermined interval, and the drive springs 5, 5' are inserted through two vertical projecting members 35, 35' to be positioned. The drive springs 5, 5' have resilient force larger than that of the return spring 22 provided on the operation frame 3', namely, the return spring 22 has only resilient force of about exceeding the tension of the drive spring 5', and when the drive spring 5' exceeds the tension, the operation frame 3' is made to rise by the resilient force of the drive spring 5'.

In each pole chamber 2, 2, 2, two main contact terminals 36, 37 are disposed at the left side of the case member S in staggered positions, inside upper position and outside lower position, and two main contact terminals 38, 39 are disposed on the right side of the case member S in staggered positions, inside upper position and outside lower position.

In each pole chamber 2, 2, 2 for main contact, a stationary contact 40 of main contact is disposed at an upper location corresponding to a rotating motion of the traveling contact 17 of main contact provided on the upper surface of tip of one traveling contact base 8 on its left side, and stationary contacts 41, 42 of main contact are disposed at upper location and lower location corresponding to rotating operations on upper surface and lower surface of the tip of the other traveling contact base 8' and the traveling contact 17' of main contact provided on the upper surface of the tip of the traveling contact base 8' is made to contact freely on the stationary contact 41 of main contact disposed at the upper portion on the right side, and a metal contact 43 for star-connection is made to contact under pressure on the stationary contact 42 of main contact disposed at the lower portion on the right side which is the lower surface of the tip of the traveling contact base 8', and the stationary contact 40 of main contact at the upper portion on the left side is connected to the main contact terminal 36 by means of the stationary contact base 44, and the stationary contact 41 of main contact at the upper portion on the right side is connected to the main contact terminal 38 by means of the stationary contact base 45.

Figure 6:
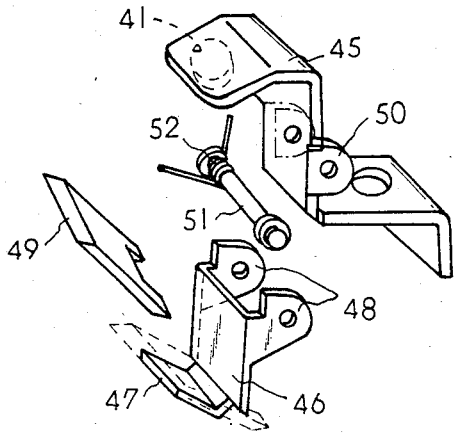
FIG. 6 is a perspective view of a disassembled metal contact.
Figure 7:
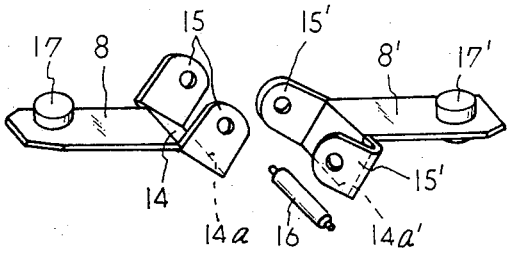
FIG. 7 is a perspective view of a pair of disassembled traveling contact bases.

The metal contact 43 is provided on the metal base 46 as shown in FIG. 6, and is connected to the stationary contact base 45. The metal base 46 is integrally projected with a bent portion 47 at its tip, and a bearing portion 48 is provided on its upper end side edge, and an insulating plate 49 is fixed on the upper surface of the bent portion 47, and the metal terminal 43 is installed on the reverse surface of the bent portion 47, and is pivotally fixed to the bearing portion 50 provided at the middle portion of the stationary contact base 45 by means of a pivotal shaft 51, and is made to freely contact the stationary contact 42 of main contact by a spring 52. Namely, the metal contact 43 is made to contact the stationary contact 42 of main contact by applying the pressure to the insulating plate 49 of the metal base 46 with the lower surface of the tip of the traveling contact base 8' on the right side to be electrically connected to the stationary contact 38 of main contact, and when it is released from the pressing force of the traveling contact base 8', it is separated and returned by the resilient force of the spring 52.

The support frame 7 of the traveling contact bases 8, 8' is provided on the base seat 12 by means of a terminal bar 53, and the main contact terminals 37, 39, and the stationary contact 42 of main contact are similarly provided by means of terminal bars 53', 53'', and the terminal bars 53', 53'' have wiring portion 54 projecting to the lower surface of the case member S, and, as will be described hereinafter, the optional terminal bar 53, 53' or 53'' is chosen to be connected on the lower surface of the case member S by each wiring portion 54 of the respective terminals bars 53, 53', 53''.

The return spring 22 is provided only on the operation frame 3' on the right side, and is installed between the projecting member 23 provided on the lower surface of the frame portion 19 and the spring seat 55 provided on the mount 25.

Figure 11:
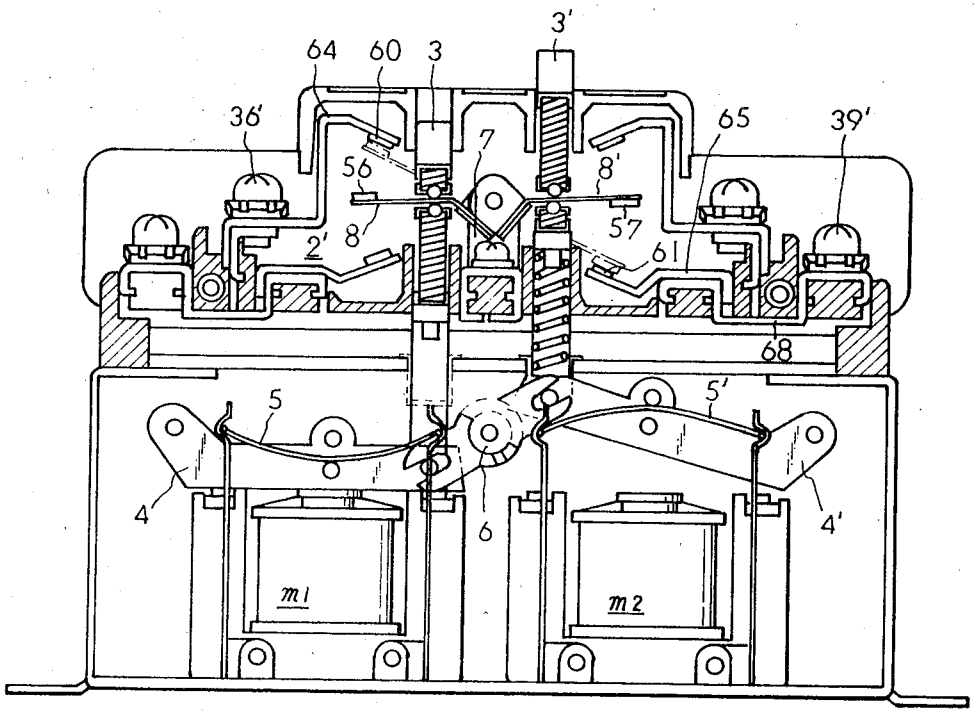
FIG. 11 is a vertical cross section showing a pole chamber of an auxiliary contact 1*b* in OFF time.
Figure 12:
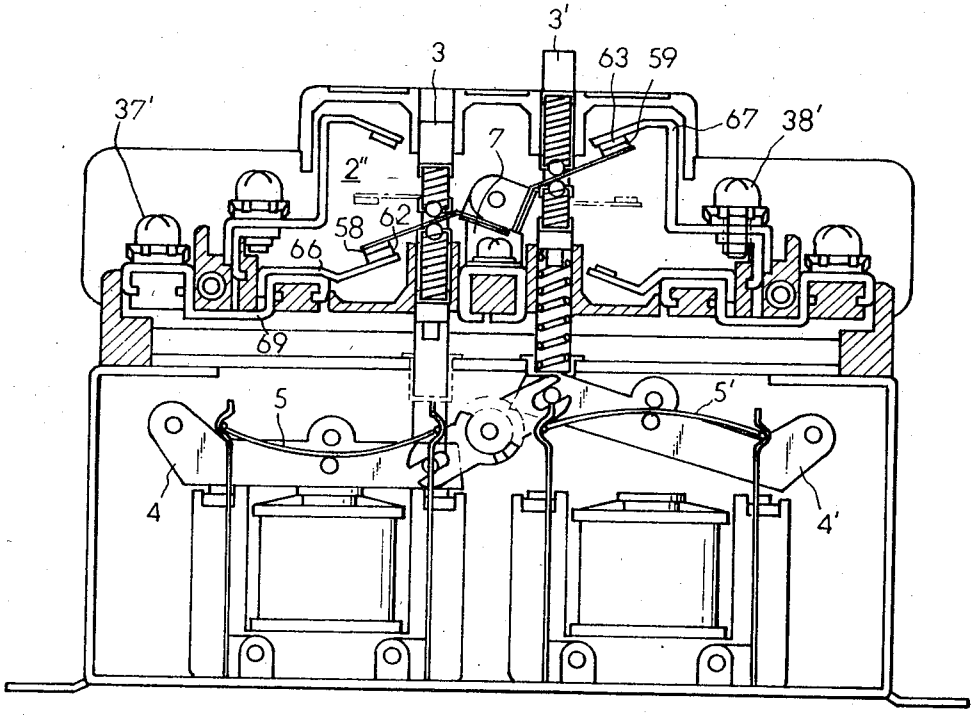
FIG. 12 is a vertical cross section showing a pole chamber of an auxiliary contact 2*b* in OFF time.

The traveling contact mechanism for the auxiliary contact is entirely similar to the traveling contact mechanism for the main contact as shown in FIGS. 11 and 12, in which the support frame 7 and the traveling contact bases 8, 8' and a pair of right and left operation frames 3, 3' are assembled, and the traveling contact bases 8, 8' are rotated to be freely bent in middle by the lifting movement of the right and left operation frames 3, 3'.

However, in the pole chamber 2' for auxiliary contact, as shown in FIG. 11, the traveling contact bases 8, 8' are constructed in such a way that traveling contacts 56, 57 for auxiliary contact are provided on the upper surface of tip on the left side and on the lower surface of tip on the right side, and in the pole chamber 2'' for auxiliary contact, as shown in FIG. 12, the traveling contact bases 8, 8' are constructed in such a way that traveling contacts 58, 59 for auxiliary contact are provided on the lower surface of tip on the left side and on the upper surface of tip on the right side, and in the pole chambers 2', 2'' for auxiliary contact, stationary contacts 60, 61, 62, 63 of auxiliary contacts are disposed at locations corresponding to the rotating operations of the traveling contacts 56–59 for auxiliary contacts, and the traveling contacts 56–59 of auxiliary contacts are freely made to contact the stationary contacts 60–63 by the rotating operations of the traveling contact bases 8, 8'. These stationary contacts 60–63 of auxiliary contacts are connected to stationary terminals 36', 39' and 37'', 38'' for auxiliary contacts disposed at the upper stage at inside and the lower stage on outside of the right and left of the case member S of each pole chamber 2', 2'' by means of the stationary contact bases 64–67 and the electroconductive bars 68, 69.

Figure 13:
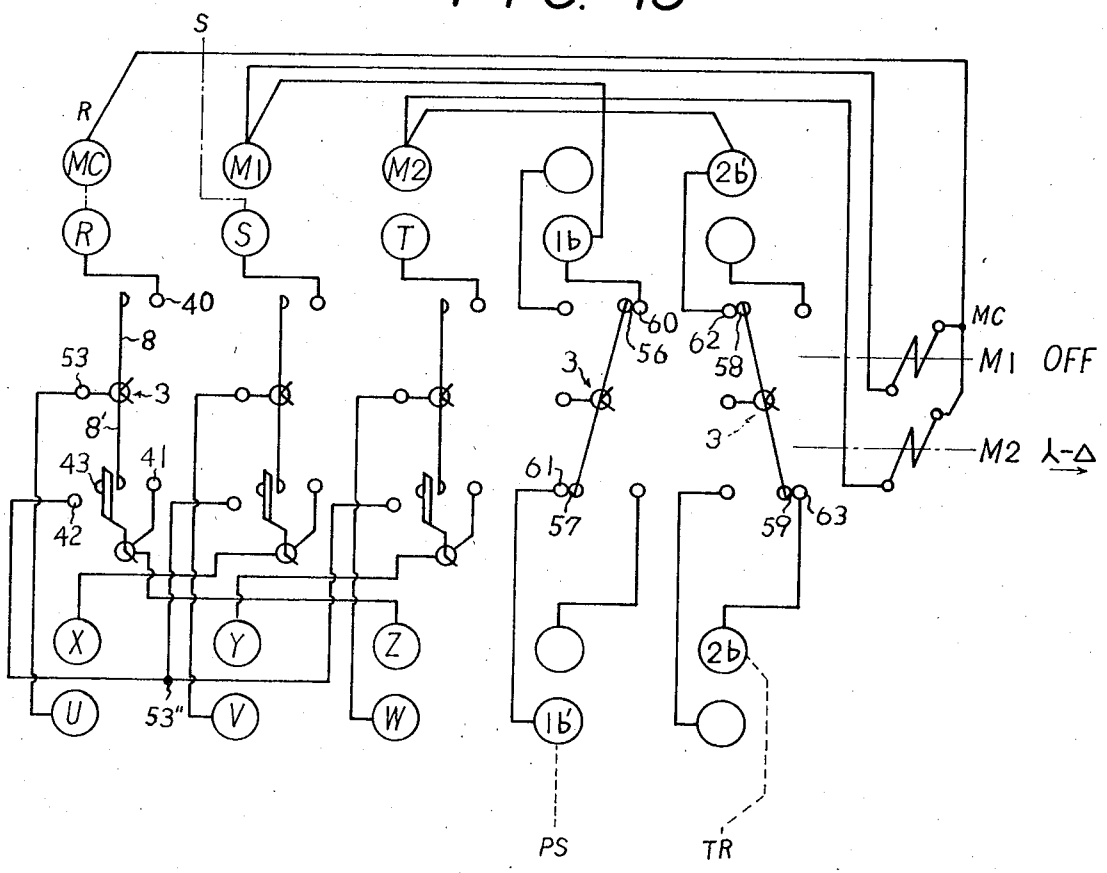
FIG. 13 is a circuit diagram showing the star-delta main circuit construction of three-contactor system.

The main contact terminal 36 provided on the upper stage on the left side of the pole chambers 2, 2, 2 for main contact of the case member S is set as a terminal on power source side, namely, R, S, T, and the main contact terminals 38, 39 of upper and lower stages on the right side are set as load side terminal, namely, the terminal 39 of the lower stage on the right side is set as the terminal U, V, W for star-connection, and the main contact terminal 38 of the upper stage on the right side is set at the terminals X, Y, Z for delta-connection, and the main contact terminal 37 the lower stage on the left side is set as terminals mc, m1, m2 connected to the electromagnets m1, m2 for OFF and star-delta connection, and the auxiliary contact terminal 36' of the upper stage on the left side of the pole chamber 2' for auxiliary contact is set as 1*b*, and the auxiliary contact terminal 39' of the lower stage on the right side is made as 1*b*', and the auxiliary contact terminal 37'' of the lower stage on the left side of the other pole chamber 2'' is set as 2*b*', and the auxiliary contact terminal 38'' of the upper stage on the right side is set as 2*b*. The terminal bar 53 of the base seat 12 of the traveling contacts 17, 17' and the terminal bar 53' of the main contact terminal 39 are connected by the connection, and the stationary contact 42 of main contact is connected to the terminal bar 53'' by the star shortcircuiting connection, and, as shown in the circuit diagram of FIG. 13, the star-delta main circuit of the three contactor system is constructed. A timer TR having a self holding circuit is connected to the auxiliary contact terminal 38'' of the pole chamber 2'', namely, the auxiliary contact 2*b*, and as shown in the circuit diagram of FIG. 14, after the making of power source and the star-connection, and after lapse of a timer set by the timer TR, the electromagnet m2 is deenergized and the making in delta is made mechanically.

Since this invention has the foregoing construction, when the electromagnet m1 is energized, the traveling iron core 4 is attracted, and the operation frame 3 on the left side is descended, and the traveling contact base 8 is rotated in the lower direction and the traveling contact 17 of main contact is separately positioned from the stationary contact 40 of main contact connected to the power source terminals R, S, T, and becomes OFF, and the auxiliary contact 2*b* is connected, and the auxiliary contact 1*b* is open, and the drive spring 5 is curved downwardly, and the operation frame 3 is retained at the descended position. In this OFF condition, as shown in FIG. 4, as both the electromagnets m1, m2 are deenergized, the drive spring 5 on the left side is curved downwardly and the operation frame 3 is retained at the descended position, and the operation frame 3 on the right side is elevated and positioned by the resilient force of the return spring 22, and the drive spring 5' on the right side is curved upwardly, and the traveling iron core 4' of the electromagnet m2 is retained at a position separated from the stationary iron core.

Figure 9:
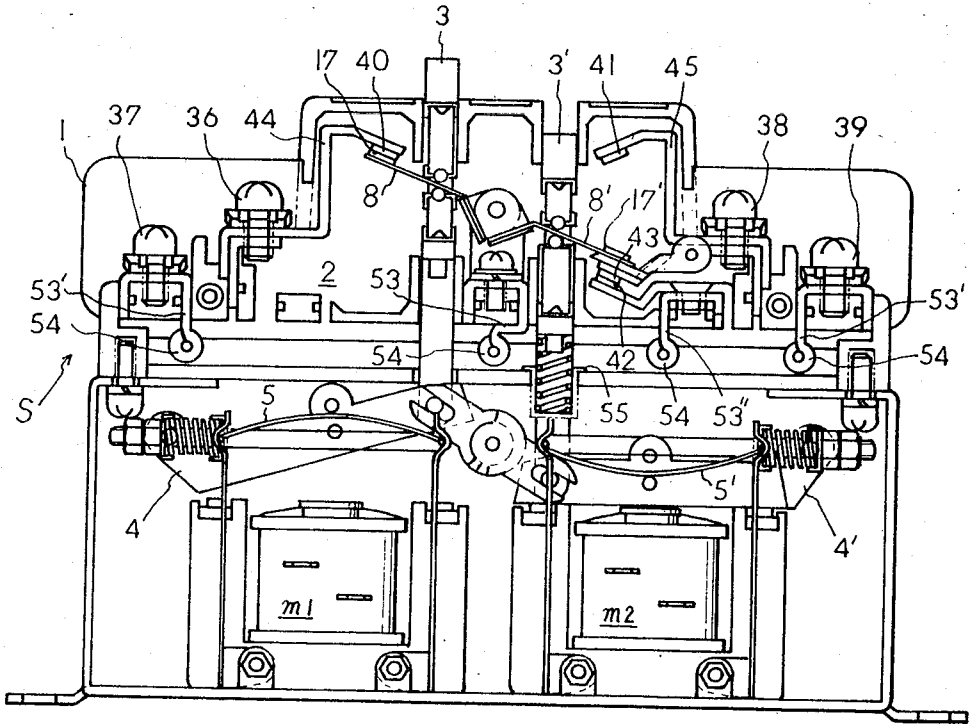
FIG. 9 is a vertical cross section showing the main contact in star-connection condition.

In case of the ON operation, as shown in FIG. 9, as the electromagnet m2 is energized, the traveling iron core 4' is attracted by resisting the right side return spring 22' and the drive spring 5' to rotate the metal cam 6. This metal cam 6 is engaged with the pawl members 32, 32' to interlock a pair of the arm portions 29, 29' integrally to be rotated, and simultaneously with the descending of the operation frame 3' on the right side, the operation frame 3 on the left side is caused to elevate and a pair of traveling contact bases 8, 8' are mutually contacted with end portions 14*a*, 14*a*' as the pair of right and left operation frames 3, 3' rise and fall, to be integrally rotated which makes seesaw movement. As shown in FIG. 9, the drive spring 5' of the electromagnet m2 is curved downward, and the drive spring 5 of the electromagnet m1 is curved upward, and the traveling contact 17 of main contact of the traveling contact base 8 on the left side is connected to the stationary terminal 40 of main contact which is the power source terminals R, S, T, and the curved portion 47 of the metal base 46 is applied with pressure on the lower surface of the tip of the traveling contact base on the right side to cause the metal contact 43 to contact the stationary contact 42 of main contact, and as shown in the circuit diagram of FIG. 13, the terminal bar 53 of the support frame 7 of the traveling contact bases 8, 8' and the terminal bar 53' of the stationary terminal 39 of main contact consisting of the terminals U, V, W for star are connected by a wiring, and the stationary contact 42 of main contact is shortcircuited by the terminal bar 53'' to start by the star-connection. In this case, the auxiliary contact 1*b* is connected, and the auxiliary contact 2*b* becomes open, and is caused to effect the self holding by the timer TR.

Figure 10:
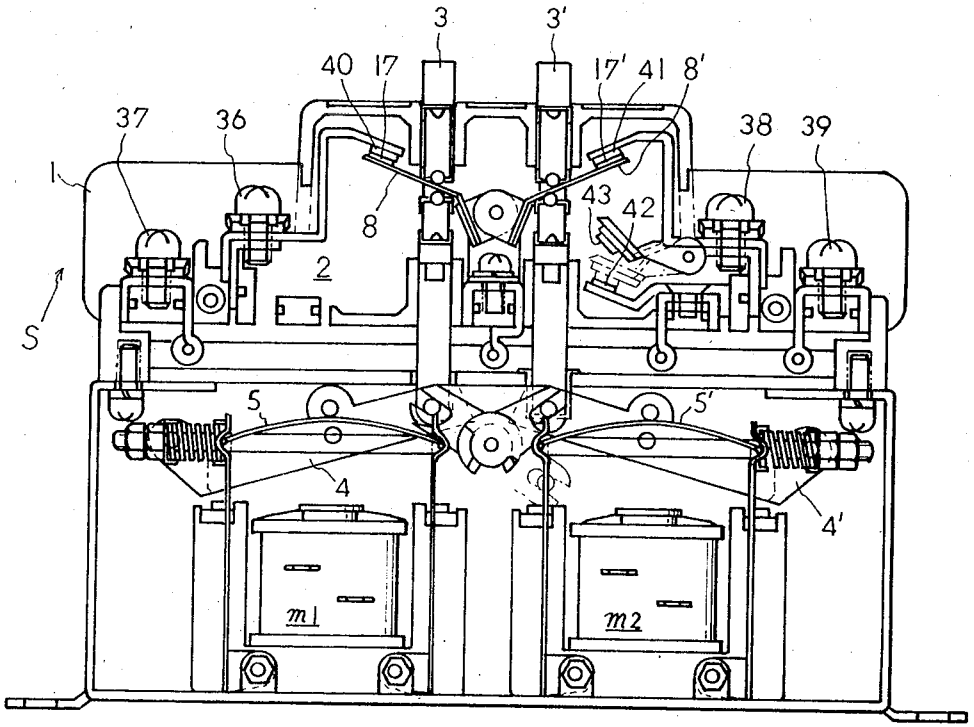
FIG. 10 is a vertical cross section showing the main contact in delta-connection.
Figure 14:
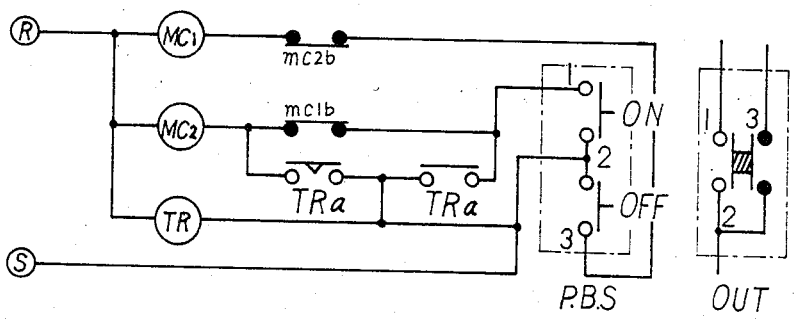
FIG. 14 is a timer circuit for connection to a circuit in FIG. 13.

After the starting with the star operation, when the set time of the timer TR connected to the auxiliary contact b' of the electromagnet m2 is elapsed, as shown in the circuit diagram of FIG. 14, the electromagnet m2 is deenergized. When the electromagnet m2 is deenergized, it is lifted until exceeding the tension of the drive spring 5' on the right side by the repulsive force of the return spring 19, and then, the operation frame 3' on the right side is elevated mechanically by the resilient force of the drive spring 5 at high speed, and as shown in FIG. 10, the traveling contact base 8' is rotated upward, and the traveling contact 17' of main contact is connected to the stationary contact 41 of main contact connected to the terminals X, Y, Z for delta, and the drive spring 5' is curved upward and is positioned. In this case, the arm portion 29' of the metal cam 6 shifting a range of the notches 31, 31' of the mutual disc portions 30, 30' is rotated singly, and similarly, a pair of the traveling contact bases 8, 8' are rotated in a direction where the end portions 14*a*, 14*a*' are separated so that the contact base 8' on the right side is rotated singly, and is bent in middle centering around the pivotal shaft 16 to connect to the terminals X, Y, Z, and the traveling contact 17 on the left side is connected to the power source terminal 40, and the drive spring 5 of the electromagnet m1 is curved upward, and the traveling iron core 4 is retained at a position separated from the stationary iron core. As shown in the circuit diagram of FIG. 13, the starting is effected with the delta connection, and during the delta connection operation, both the electromagnets m1 and m2 become the deenergized condition. In the delta connection operation, the self holding circuit is released by the time up of the timer TR, and both the auxiliary contacts 1*b* and 2*b* are closed.

In case of suspending the delta connection operation, when the electromagnet m1 is energized, the traveling iron core 4 is attracted and the drive spring 5 is curved downward. The electromagnet m1 is deenergized when the drive spring 5 exceeds the tension and is curved downward, and the operation frame 3 is caused to descend by the resilient force of the drive spring 5, and the traveling contact 17 of main contact is separated from the power source terminals R, S, T. When the operation frame 3 is descending, the end portion 14*a* of the traveling contact base 8 of main contact is at a position separated from the end portion 14*a*' of the traveling contact base 8', and at the same time, the mutual pawl members 32, 32' of the metal cam 6 are separately positioned so that the traveling contact base 8 is rotated singly without influencing over the traveling contact base 8', and the traveling contact 17 is separated from the power source terminals X, Y, Z as shown in FIG. 4, to become the OFF condition.

Accordingly, this invention provides a novel contactor that provides a star-delta main circuit construction of three-contactor system in an integral structural member. This novel contactor cuts the number of contacts used by half when compared with the conventional models, and when the electromagnet is deenergized, the delta connection is mechanically formed by the spring force. For example, this novel contactor not only eliminates the various troubles such as adverse influences over adjacent equipment due to temperature rise or noise of roaring or buzzing resulting from the energization of the electromagnets for long hours during the delta connection operation of motor but also saves on the electric energy on account of use of numerous electromagnets. Heretofore, with respect to the number of contactors used, 3 units are required, but now only one is enough, and moreover, the contactor according to this invention is of compact size and light weight when compared with the conventional one contactor, and the accommodating space for starter is reduced which makes feasible various economical designs for various equipment, resulting in numerous advantages of this invention.

What is claimed is:

1. A contactor, comprising (a) a case member provided with a plurality of pole chambers which are serially and vertically sectioned by diaphragms, (b) a traveling contact member arranged in each of said pole chambers, (c) a traveling contact of main contact made of a slide metal and being pivotally fixed to a pair of traveling contact bases and being integrated in a direction where mutual end portions of said pair of contact bases are engaged to cause seesaw movement by the interlocking movement thereof and being independently rotated in a direction where the mutual end portions are separated, (d) stationary contacts of main contact disposed at an upper position on one side of each of said pole chambers, and at positions of an upper and lower portion on the other side of each of said pole chambers, metal contacts pivotally fixed to the contact base of the stationary contact of main contact of the upper portion on the other side to be energized and capable of freely contacting the stationary contact of main contact at the lower portion on the other side, (e) a pair of right and left operation frames provided with a frame portion with a window having a pair of vertically disposed contact springs and a leg portion suspending and extending integrally from one side portion on the lower surface of the frame portion and being liftable at right and left of the traveling contact and allowing the traveling contact base to extend through the window and being sandwiched by said pair of vertically disposed contact springs, and (f) a drive device for individually lifting said pair of right and left operation frames.

2. A contactor according to the claim 1 in which said pair of traveling contact bases forming the traveling contact are provided with a bent portion formed by aslantly bending the respective base ends in a predetermined angle and bearing portions are provided at both sides of the bent portion and said pair of traveling contact bases are formed in the slide metal construction in which the end portions of the bent portion are mutually engageable and being pivotally fixed at the mutual bearing portions and when either traveling contact base is rotated in a direction where the end portions of the bent portions are engaged, said pair of traveling contact bases are integrated to make seesaw movement by an interlocking rotation, and when either traveling contact base is rotated in a direction where the end portions of the bent portions are separated, said pair of traveling contact bases are singly rotated and bending in middle at the connecting portion.

3. A contactor according to the claim 1 in which the metal contact is provided with the metal base, and the metal base is provided with the bent portion at its tip and with the bearing portion at side edge of the upper end, and an insulating plate is provided on the upper surface of the bent portion of the metal base, and a metal terminal is provided on the reverse surface of the bent portion and the bearing portion is provided in middle of the stationary contact base of main contact provided on the upper portion on the other side and the bearing portion is pivotally fixed to the bearing portion of the metal base to be resilient in upper direction, and the metal contact is made to freely contact the stationary contact of main contact on the lower surface on the other side by urging the insulating plate against the lower surface of the tip of the traveling contact base.

4. A contactor, comprising (a) a case member provided with a plurality of pole chambers which are serially and vertically sectioned by diaphragms, (b) a traveling contact member arranged in each of said pole chambers, (c) a traveling contact of main contact made of a slide metal and being pivotally fixed to a pair of traveling contact bases and being integrated in a direction where mutual end portions of said pair of contact bases are engaged to cause seesaw movement by the interlocking movement thereof and being independently rotated in a direction where the mutual end portions are separated, (d) stationary contacts of main contact disposed at an upper position on one side of each of said pole chambers, and at positions of an upper and lower portion on the other side of each of said pole chambers, metal contacts pivotally fixed to the contact base of the stationary contact of main contact of the upper portion on the other side, to be energized and capable of freely contacting the stationary contact of main contact at the lower portion on the other side, (e) a pair of right and left operation frames provided with a frame portion with a window having a pair of vertically disposed contact springs and a leg portion suspending and extending integrally from one side portion on the lower surface of the frame portion and being liftable at right and left of the traveling contact and allowing the traveling contact base to extend through the window and being sandwiched by said pair of vertically disposed contact springs, (f) two electromagnets m1, m2 provided at right and left on the lower portion of the case member, (g) a return spring provided only on the operation frame on the other side, (h) a drive spring made of plate spring provided on the traveling iron core of each of said electromagnets m1, m2, and (i) a metal cam pivotally fixed to the lower end of the case member and being coaxially pivotally fixed to the lower end of the leg of the operation frame and the tip of each of said traveling iron cores to move interlockingly, whereby the electromagnet m2 is energized for making and star connection starting, and the delta connection is mechanically effected by the spring force when the electromagnet deenergizes the delta connection in the traveling contact of main contact and the stationary contact of main contact.

5. A contactor according to the claim 4 in which the metal cam is provided with a disc portion on each base end side of a pair of arm portions, and each of said disc portions is provided with a notch formed at a predetermined portion obliquely downward of an outer periphery, a pawl member projecting to an end portion on lower side of the notch and a center hole, and each of said pawl members is positioned in the notch on opposite side to superpose the mutual disc portions, and a pivotal shaft is inserted into the center hole to be fixed to the lower surface of the case member, and each of said arm portions is pivotally fixed to the lower end of the predetermined operation frame and the tip of each of said traveling iron cores, and the pawl member is rotated in a range of the notch, and when the mutual pawl members are engaged, they are integrated to make an interlocking rotation.

6. A contactor, comprising (a) a case member provided with a plurality of pole chambers which are serially and vertically sectioned by diaphragms, (b) a traveling contact member arranged in each of said pole chambers, (c) a traveling contact of main contact made of a slide metal and being pivotally fixed to a pair of traveling contact bases at a connecting portion and bending in middle, (d) stationary contacts of main contact disposed at an upper position on one side of each of said pole chambers, and at positions of said pole chambers, metal contacts pivotally fixed to the contact base of the stationary contact of main contact of the upper portion on the other side to be energized and capable of freely contacting the stationary contact of main contact at the lower portion on the other side, (e) a pair of right and left operation frames provided with a frame portion with a window having a pair of vertically disposed contact springs and a leg portion suspending and extending integrally from one side portion on the lower surface of the frame portion and being liftable at right and left of the traveling contact and allowing the traveling contact base to extend through the window and being sandwiched by said pair of vertically disposed contact springs, (f) two electromagnets m1, m2 provided at right and left on the lower portion of the case member, (g) a return spring provided only on the operation frame on the other side, (h) a drive spring made of plate spring provided on the traveling iron core of each of said electromagnets m1, m2, (i) a metal cam pivotally fixed to the lower end of the case member and being coaxially pivotally fixed to the lower end of the leg of the operation frame and the tip of each of said traveling iron cores to move interlockingly, whereby the main contact terminals of upper stage on the left side of the case member are made as power source terminals R, S, T, and the main contact terminals of lower stage on the right side of the case member are made as terminals U, V, W for star connection, and the main contact terminals of the upper stage on the right side are set as terminals X, Y, Z for delta connection, and the main contact terminals of the lower stages on the left side are made as terminals mc, m1, m2 connected to the electromagnets m1, m2 for OFF and for star-delta connection, and an auxiliary contact terminal of the upper stage on the left side of the one pole chamber for auxiliary contact is made as *1b*, and the auxiliary contact terminal of the lower stage on the right side is made as *1b'*, and the auxiliary contact terminal of the lower stage on the left side of the other pole chamber is made as *2b*, and the auxiliary contact terminal of the upper stage on the right side is set as *2b*, and the terminal bar provided on the base seat of the traveling contact of main contact and the terminal bar of the main contact terminal of the lower stage on the right side are connected, and the terminal bar of the stationary contact of main contact of the lower stage on the right side is connected in star shortcircuiting to form a star-delta main circuit of three-contactor system.

7. A contactor according to the claim 6 in which a timer TR provided with a self holding circuit is connected to the auxiliary contact *2b*, and the electromagnet m2 is deenergized upon the lapse of the time set by the timer TR after the making of the power source and the star connection.

* * * * *